US007919221B2

(12) United States Patent
Asami et al.

(10) Patent No.: US 7,919,221 B2
(45) Date of Patent: Apr. 5, 2011

(54) ELECTROPHOTOGRAPHIC PRINTING TONER, ELECTROPHOTOGRAPHIC PRINTING METHOD AND LIQUID DEVELOPER FOR ELECTROPHOTOGRAPHIC PRINTING

(75) Inventors: Tsuyoshi Asami, Yokohama (JP); Aiko Yamazaki, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 943 days.

(21) Appl. No.: 11/755,756

(22) Filed: May 31, 2007

(65) Prior Publication Data

US 2008/0199791 A1 Aug. 21, 2008

(30) Foreign Application Priority Data

Feb. 16, 2007 (JP) ..... 2007-036209
May 31, 2007 (JP) ..... 2006-151791

(51) Int. Cl.
*G03G 9/00* (2006.01)

(52) U.S. Cl. ..... 430/114; 430/108.21; 430/108.23; 430/48

(58) Field of Classification Search ..... 430/108.21, 430/108.23, 114, 48
See application file for complete search history.

(56) References Cited

U.S. PATENT DOCUMENTS 5,102,763 A * 4/1992 Winnik et al. ..... 430/108.24
6,447,973 B1 9/2002 Asami et al.
6,692,881 B2 2/2004 Tsubuko et al.
7,122,287 B2 10/2006 Asami et al.
2004/0259015 A1 12/2004 Tsubuko et al.
2006/0106132 A1* 5/2006 Ma et al. ..... 523/160
2006/0222985 A1 10/2006 Tsubuko et al.

FOREIGN PATENT DOCUMENTS

| | | |
|---|---|---|
| JP | 05-027474 | 2/1993 |
| JP | 05-033275 | 2/1993 |
| JP | 07-138888 | 5/1995 |
| JP | 07-278482 | 10/1995 |
| JP | 08-226083 | 9/1996 |
| JP | 09-073198 | 3/1997 |
| JP | 10-195776 | 7/1998 |
| JP | 10-239916 | 9/1998 |
| JP | 10-254179 | 9/1998 |
| JP | 11-279959 | 10/1999 |
| JP | 11-282215 | 10/1999 |
| JP | 11-286880 | 10/1999 |
| JP | 2000-029238 | 1/2000 |
| JP | 2000-110085 | 4/2000 |
| JP | 2002-251039 | 9/2002 |
| JP | 2002-278171 | 9/2002 |
| JP | 2003-096340 | 4/2003 |

* cited by examiner

*Primary Examiner* — Mark A Chapman

(74) *Attorney, Agent, or Firm* — Oblon, Spivak, McClelland, Maier & Neustadt, L.L.P.

(57) ABSTRACT

An electrophotographic printing toner including a colorant and a resin, wherein the colorant includes a dye having at least one reactive group selected from the group consisting of $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4.

20 Claims, 3 Drawing Sheets

ELECTROPHOTOGRAPHIC PRINTING TONER, ELECTROPHOTOGRAPHIC PRINTING METHOD AND LIQUID DEVELOPER FOR ELECTROPHOTOGRAPHIC PRINTING

BACKGROUND OF THE INVENTION

1. Field of the Invention

The present invention relates to a toner for use in electrophotographic printing, and an electrophotographic printing method and a liquid developer for electrophotographic printing using the toner.

2. Discussion of the Background

The printing method is used a variety of fibers such as threads, fabrics and secondary textile products, and mainly includes roller printings using anastatic printings, screen printings and stencil printings. Specific examples of the screen printings include manual printings, semi-automatic screen printings, automatic running screen printings, flat or rotary automatic screen printings, etc.

The roller printing needs a process of engraving a design on a metallic roller which is difficult to handle. The screen printing takes time to prepare a screen and a trouble to print. The rotary screen printing also takes time to prepare a screen and engraving a roller. Conventional printing methods take troubles and long times, and simple printing methods are desired.

Published Unexamined Japanese Patent Applications Nos. 10-195776, 2003-96340, 7-278482 and 8-226083; and Japanese Patent No. 2995135 disclose short-time printing methods using an inkjet, omitting a process of engraving a plate. However, the printing methods using an inkjet cannot increase the density and the density changes while printing.

In order to solve these problem, electrophotographic printing methods are being developed recently. Published Unexamined Japanese Patent Applications Nos. 5-027474 and 5-033275 disclose a method of forming an electrostatic latent image on a photoreceptor, adhering a toner to the electrostatic latent image to form a toner image thereon, transferring the toner image onto clothes, and fixing the toner thereon with heat. However, the electrophotographic printing method uses a dry toner forming a thick toner layer on the cloth, resulting in rough touch. In addition, a resin physically adheres to a fiber, resulting in poor abrasion resistance and washing resistance.

Published Unexamined Japanese Patent Applications Nos. 9-73198 and 10-239916 disclose an electrophotographic printing method using a liquid toner, wherein a liquid toner including a sublimation dye is subjected to an ion stream to be developed, the developed design is printed on a transferer, and sublimated and thermal-transferred onto clothes. This is a simple method and the printed clothes have natural touch, but the second color thereon does not have sufficient density, and have poor washing resistance. In addition, the toner does not penetrate to the back of the cloth and both sides there of need printing. Further, after the toner is transferred to the cloth, a paper (the transferer) is wasted.

Published Unexamined Japanese Patent Application No. 2000-110085 discloses a magenta liquid printing toner using an anthraquinone colorant, which has improved colorability and density, but deteriorates in chargeability and dispersibility when used for long periods.

In ordinary screen printings, an ordinary printing method differs in a point that a dye adheres to a cloth in the form of a colored adhesive from the electrophotographic printing method wherein a dye of adheres to a cloth in the shape of a particle. Therefore, in the ordinary printing method, the cloth and the dye do not sufficiently react each other, resulting in deterioration of coloring density.

Because of these reasons, a need exists for an electrophotographic printing toner having good chargeability, dispersibility and dyeing capability of dyeing objects to have high image density.

SUMMARY OF THE INVENTION

Accordingly, an object of the present invention is to provide an electrophotographic printing toner having good chargeability, dispersibility and dyeing capability of dyeing objects to have high image density.

Another object of the present invention is to provide an electrophotographic printing method using the toner.

A further object of the present invention is to provide a liquid developer for electrophotographic printing using the toner.

Another object of the present invention is to provide an economical on-demand electrophotographic printing method wherein the printing operation is largely streamlined.

These objects and other objects of the present invention, either individually or collectively, have been satisfied by the discovery of an electrophotographic printing toner, comprising:

a colorant; and a resin, wherein the colorant comprises a dye having at least one reactive group selected from the group consisting of $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4.

The dye preferably has the following formula (1), (2) or (3):

(1)

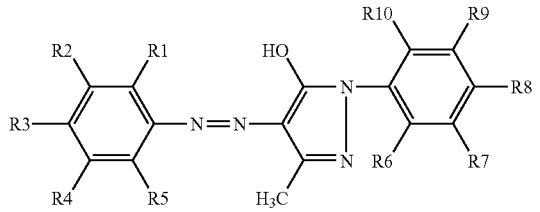

wherein R1 to R10 independently represent H, $C_nH_{2n+1}$, $OC_nH_{2n+1}$, $OCOC_nH_{2n+1}$, COOH, Cl, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4;

(2)

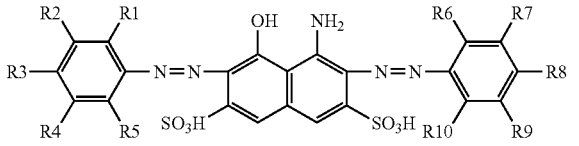

wherein R1 to R10 independently represent H, $OC_nH_{2n+1}$, $NO_2$, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4;

(3)

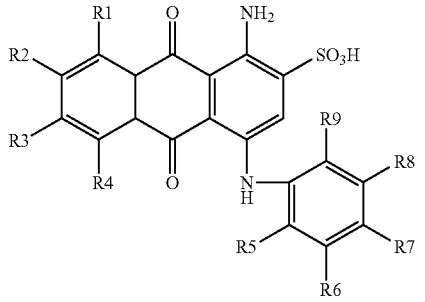

wherein R1 to R9 independently represent H, $OC_nH_{2n+1}$, $NO_2$, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Figure 1:
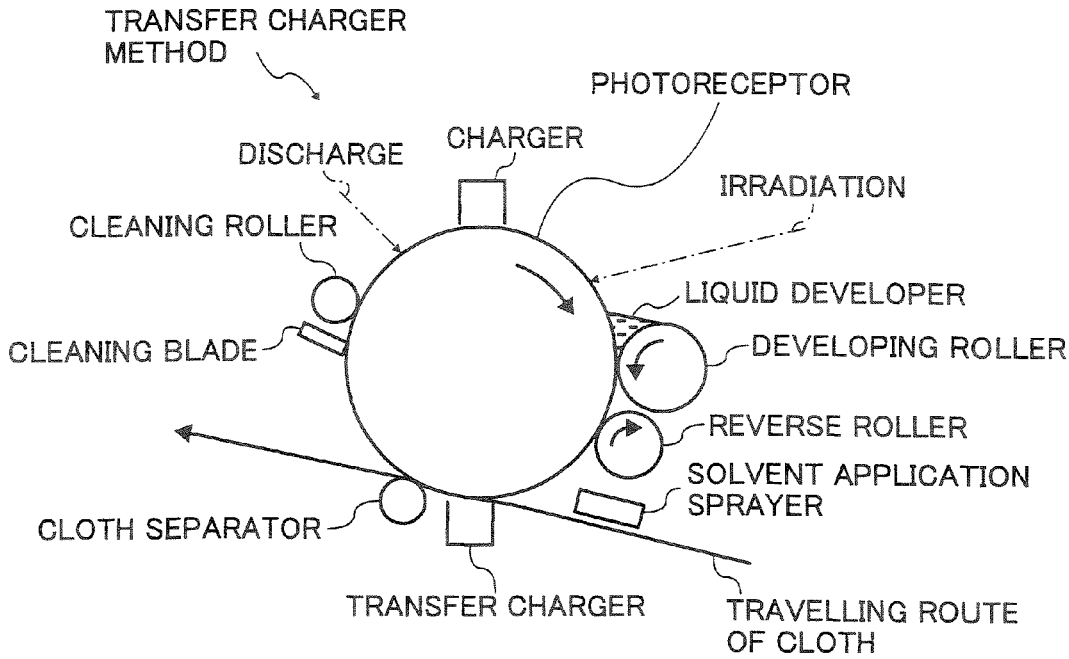
FIG. 1 is a schematic view illustrating an embodiment of an image forming apparatus using a transfer charger for use in the electrophotographic printing method of the present invention.

The present invention provides an electrophotographic printing toner having good chargeability, dispersibility and dyeing capability of dyeing objects to have high image density.

The electrophotographic printing toner of the present invention includes at least a colorant and a resin, wherein the colorant includes a dye having at least one of $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4.

The colorant having at least one of the following formulae is preferably used.

(1)

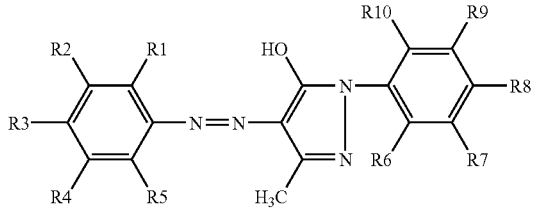

wherein R1 to R10 independently represent H, $C_nH_{2n+1}$, $OC_nH_{2n+1}$, $OCOC_nH_{2n+1}$, COOH, Cl, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4;

(2)

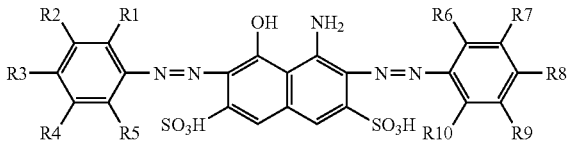

wherein R1 to R10 independently represent H, $OC_nH_{2n+1}$, $NO_2$, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4; and (3)

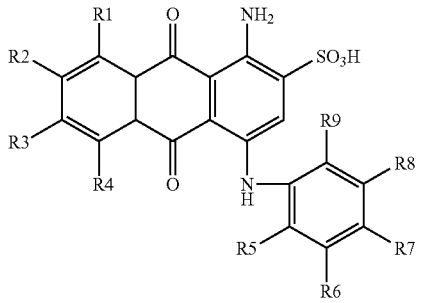

wherein R1 to R9 independently represent H, $OC_nH_{2n+1}$, $NO_2$, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, wherein n represents an integer of from 1 to 4.

Specific examples of the dye having the formula (1) include the following dyes in Table 1.

TABLE 1

| Dye | R1 | R2 | R3 | R4 | R5 | R6 | R7 | R8 | R9 | R10 |
|---|---|---|---|---|---|---|---|---|---|---|
| 1A | $OCH_3$ | H | H | $SO_2C_2H_4OSO_3H$ | H | Cl | H | $SO_3H$ | H | $CH_3$ |
| 1B | $SO_3H$ | H | Cl | COOH | H | H | H | $SO_2C_2H_4OSO_3H$ | H | H |
| 1C | $OCH_3$ | H | H | $NHCOC_2H_4OSO_3H$ | H | Cl | H | $SO_3H$ | H | $CH_3$ |
| 1D | $SO_3H$ | H | $OCOCH_3$ | H | H | H | H | $COC_2H_4OSO_3H$ | H | H |
| 1E | $OCH_3$ | H | H | $SO_2CHCH_2$ | H | Cl | H | $SO_3H$ | H | $CH_3$ |
| 1F | $SO_3H$ | H | $NHSO_2C_2H_4OSO_3H$ | H | H | H | H | $SO_3H$ | H | $CH_3$ |
| 1G | $SO_3H$ | H | $SO_3H$ | COOH | H | H | H | $NHCOC_2H_4OSO_3H$ | H | H |
| 1H | $OCH_3$ | H | $SO_2C_2H_4OSO_3H$ | $OCH_3$ | H | H | H | $SO_3H$ | H | H |

Specific examples of the dye having the formula (2) include the following dyes in Table 2.

TABLE 2

| Dye | R1 | R2 | R3 | R4 | R5 | R6 | R7 | R8 | R9 | R10 |
|---|---|---|---|---|---|---|---|---|---|---|
| 2A | H | H | $SO_2C_2H_4OSO_3H$ | H | H | H | H | $SO_2C_2H_4OSO_3H$ | H | H |
| 2B | H | H | $NHCOC_2H_4OSO_3H$ | H | H | H | H | $NHCOC_2H_4OSO_3H$ | H | H |
| 2C | H | H | $SO_2CH_2OSO_3H$ | H | H | H | H | $SO_2CH_2OSO_3H$ | H | H |
| 2D | $SO_3H$ | H | H | H | H | H | H | $SO_2C_2H_4OSO_3H$ | H | H |
| 2E | $SO_3H$ | H | $OCH_3$ | $SO_3H$ | H | H | H | $COC_2H_4OSO_3H$ | H | H |
| 2F | $OCH_3$ | H | H | $SO_2CH_2OSO_3H$ | H | $OCH_3$ | H | H | $SO_2CH_2OSO_3H$ | H |
| 2G | H | H | $NO_2$ | H | H | $OCH_3$ | H | $SO_2C_2H_4OSO_3H$ | $OCH_3$ | H |
| 2H | H | H | $SO_2CHCH_2$ | H | H | H | H | $SO_3H$ | H | H |
| 2I | H | H | $NHSO_2C_2H_4OSO_3H$ | H | H | H | H | $SO_3H$ | H | H |

Specific examples of the dye having the formula (3) include the following dyes in Table 3.

TABLE 3

| Dye | R1 | R2 | R3 | R4 | R5 | R6 | R7 | R8 | R9 |
|---|---|---|---|---|---|---|---|---|---|
| 3A | H | H | H | H | H | $SO_2C_2H_4OSO_3H$ | H | H | H |
| 3B | H | $SO_3H$ | H | H | H | $NHCOC_2H_4OSO_3H$ | H | H | H |
| 3C | H | H | $SO_3H$ | H | H | $SO_2CH_2OSO_3H$ | H | H | H |
| 3D | H | H | $OCH_3$ | H | H | H | H | $COC_2H_4OSO_3H$ | H |
| 3E | H | H | H | H | H | H | H | $SO_2CHCH_2$ | H |
| 3F | H | H | H | H | H | H | H | $NH\ SO_2C_2H_4OSO_3H$ | H |
| 3G | H | H | H | H | H | $NHCOC_2H_4OSO_3H$ | H | H | H |

The dye having the formula (1) can be prepared by, e.g., diazotizing an aromatic amine compound having a sulfatoethylsulfone group or a vinylsulfone group and the following formula (4) by a conventional method; and coupling the resultant diazo compound with a pyrazolone compound having the following formula (5):

(4)

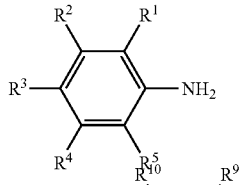

(5)

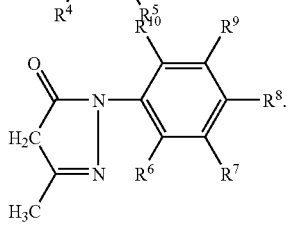

The dye having the formula (2) can be prepared by, e.g., diazotizing an aromatic amine compound having a sulfatoethylsulfone group or a vinylsulfone group and the following formula (6) by a conventional method; coupling the resultant diazo compound with 8-amino-1-hydroxynaphthalene-3,6-disulfonate at a temperature of from 20 to 30° C. and a pH of from 2 to 4; and coupling the resultant coupling reaction product with a diazotized aromatic amine compound having a sulfatoethylsulfone group or a vinylsulfone group and the following formula (8) at a temperature of from 30 to 40° C. and a pH of from 5 to 8:

(6)

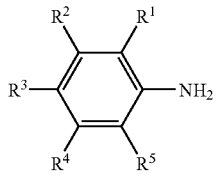

(7)

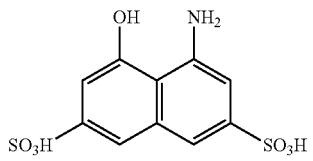

-continued (8)

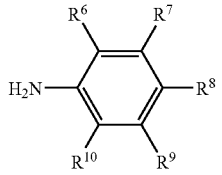

The dye having the formula (3) can be prepared by, e.g., chlorinating anthracene to 9,10-dichor or oxidizing anthracene to anthraquinone; and synthesizing the resultant materials. An embodiment thereof is shown by the following formulation (9):

(9)

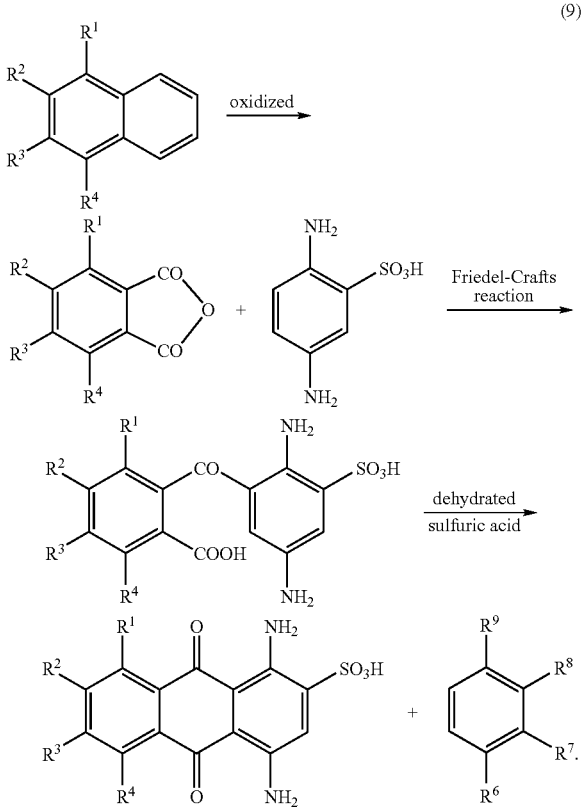

A reaction between the dye 1A and a cellulose fiber (receiving material) is shown by the following formulation (10):

(10)

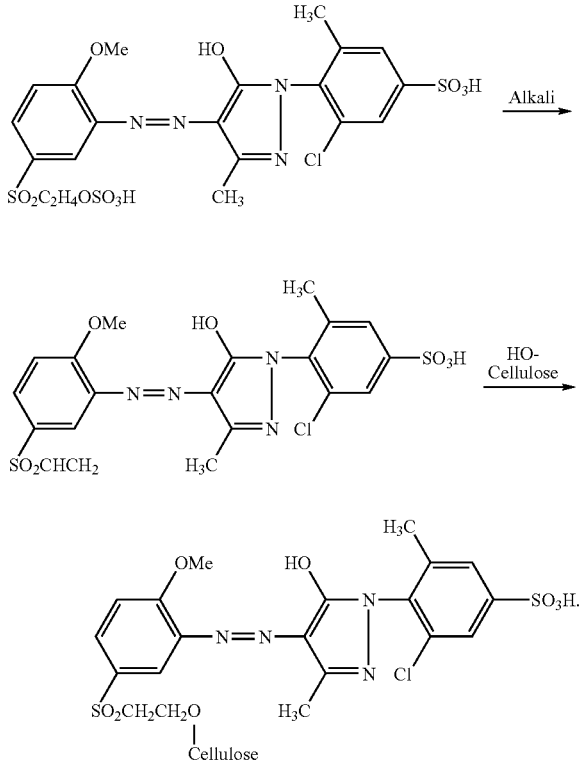

Namely, reaction groups such as $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$ react with the receiving material to dye the receiving material. When a molecule of the dye includes two or more of the reaction groups, the dyeing capability thereof improves more than the dye including one of the reaction groups.

In addition, a reaction between the dye 2A and a cellulose fiber (receiving material) is shown by the following formulation (11):

(11)

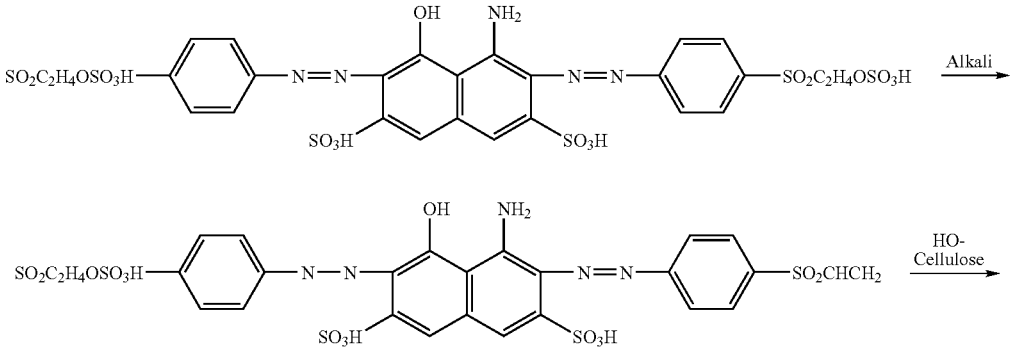

-continued

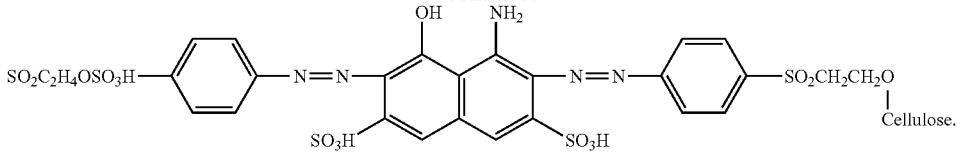

The dyeing mechanism and improvement are same as those of the dye 1A.

Further, a reaction between the dye 3A and a cellulose fiber (receiving material) is shown by the following formulation (12):

(12)

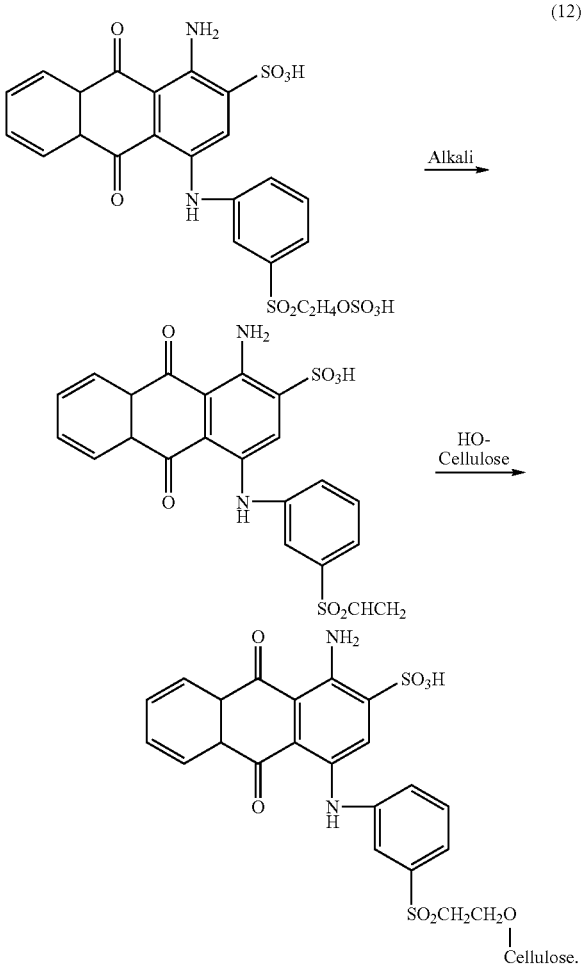

The dyeing mechanism and improvement are same as those of the dye 1A.

Other dyes can be mixed with the dye having the formula (1), (2) or (3). The mixing ratio thereof is preferably not greater than 30% by weight based on total weight of the dyes.

Marketed powdery dyes mostly have a dye purity of more or less 50% and include large amounts of salts and salt cakes, and have a bad influence upon the resistivity and chargeability of the resultant liquid. Therefore, it is preferable that the dye is refined or originally includes less salt. The powdery dye preferably has a dye purity not less than 80% by weight.

The purity is measured by the following dissolution and reprecipitation method:

extracting a dye with a solvent such as N,N-dimethylformamide dissolving only the dye without dissolving inorganic salts such as a salt and a salt cake;

mixing a solvent such as acetone with the resultant dye solution to precipitate the dye; and determining the purity by the following formula:

Weight of the precipitated dye/Weight of original dye×100 (%)

The electrophotographic printing toner may be a dry or a liquid electrophotographic printing toner.

The dry electrophotographic printing toner can be prepared by mixing a colorant, a binder, a charge controlling agent, etc. to prepare a mixture; kneading the mixture with a kneader such as Buss Ko-Kneader to prepare a kneaded mixture; crushing and pulverizing the kneaded mixture to prepare a pulverized mixture; and classifying the pulverized mixture. The contents of the colorant, binder and charge controlling agent are optionally determined, and preferably from 5 to 15% by weight, 80 to 95% by weight and 1 to 10% by weight, respectively.

The liquid electrophotographic printing toner can be prepared by dispersing and kneading a colorant, an additive such as a binder and a carrier liquid with a disperser such as ball mill, a keddy mill, a disc mill and a pin mill to prepare a condensed printing toner which is marketed as a liquid electrophotographic printing toner. The carrier liquid is further added thereto when used. The contents of the colorant, binder, carrier liquid and charge controlling agent are optionally determined, and preferably from 5 to 10% by weight, 5 to 20% by weight, 70 to 95% by weight and 0.1 to 1% by weight, respectively.

Conventional printing inks do not need to have specific electrical properties because of forming images with plates, however, the chargeability of the electrophotographic printing inks are essential because of forming images with positive or negative electrical properties. The reason why the dye having the formula (1), (2) or (3) has good charge ability is not clarified, but it is considered to be due to a delicate balance among the dye skeleton, electron-absorbing group and electron-donating group.

The binder does not finally bind the colorant to a material to be printed, but the colorant itself has bindability, and the binder is temporarily charged only to attach the toner to the material to be printed and is removed in the following soaping process. When the binder remains, the texture of the material to be printed deteriorates. Therefore, the binder is preferably removable by soaping, such as an alkali-soluble resin and a water-soluble resin.

When the binder includes an alkali-soluble resin or a water-soluble resin, the resins in the toner dissolves in the coloring process, washing process and soaping process, and leaves from clothes, resulting in printed clothes having good textures.

Specific examples of the alkali-soluble resin and water-soluble resin include a water-soluble melamine resin, a water-soluble rosin-modified resin, a water-soluble polyester resin, a water-soluble acrylic resin, a water-soluble epoxy resin, polyvinylalcohol, polyvinylpyrrolidone, polyethyleneimine, carboxymethylcellulose, sodium alginate, collagen, gelatin, starch, chitosan, etc.

Specific examples of marketed products thereof include POVAL (PVA) and ISOBAN (isobutylene/maleateresin) from Kuraray Co., Ltd.; NEOTOL and HARIDIP (alkyd resin and acrylic resin) from HARIMA CHEMICALS, INC.; ECOATY (PVA) from Nippon Synthetic Chemical Co., Ltd.; DECONAL (epoxy resin) and CABSEN (polyester resin) from Nagase ChemteX Corp.; JURYMER (acrylic resin) from NIHON JUNYAKU Co., Ltd.

The alkali-soluble resin or water-soluble resin preferably has an acid value of from 0 to 2,000 mg/KOH for the resultant toner to produce high-quality images. When higher than 2,000 mg/KOH, the developability of the resultant toner deteriorates.

The binder resins besides the alkali-soluble resin and water-soluble resin include styrene-acrylic resins, polyester resins, epoxy resins, etc. for the dry electrophotographic printing toner; and polyolefin resins, epoxy resins, polyester resins, etc. for the liquid electrophotographic printing toner.

The electrophotographic printing toner preferably includes the alkali-soluble resin or water-soluble resin in an amount of 10 to 80% by weight, and more preferably from 40 to 70% by weight based on total weight of the binder resin. When too much, the chargeability of the resultant toner deteriorates. When too little, the resultant texture deteriorates.

Specific examples of a resin for dispersion, which is preferably used together in the present invention, include copolymers or graft copolymers between a vinyl monomer A having the following formula (13) and a monomer B having the following formula (14) selected from the group consisting of a vinyl monomer, a vinylpyridine, vinylpyrrolidone, ethyleneglycoldimethacrylate, styrene, divinylbenzene and vinyltoluene.

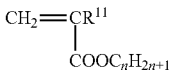

(13)

wherein $R^{11}$ represents H or $CH_3$; and n represents an integer of from 6 to 20.

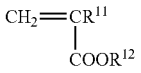

(14)

wherein $R^{11}$ represents H or $CH_3$; and $R^{12}$ represents an alkyl group having 1 to 4 carbon atoms.

The liquid electrophotographic printing toner including the colorant having the formula (1), (2) or (3) dispersed in a high-resistivity and low-dielectric carrier liquid having a volume resistivity not less than $10^9$ Ω·cm has good transferability and produces high-quality printings having good density and resolution. When less than $10^9$ Ω·cm, the potential of a photoreceptor, the chargeability and electrophoresis of the toner deteriorate, causing deterioration of image density and blur of the resultant images. There is no maximum limit of the volume resistivity and conventional carrier liquids have a maximum of $10^{16}$ Ω·cm.

Specific examples of the carrier liquid include saturated aliphatic hydrocarbons such as isoparaffin hydrocarbons, and silicone oils. Specific examples of the isoparaffin hydrocarbons include ISOPER-C, ISOPER-E, ISOPER-G, ISOPER-H, ISOPER-L, ISOPRT-M, ISOPER-V, SOLVESSO 100, SOLVESSO 150, SOLVESSO 200, EXXOL 100/140, EXXOL D30, EXXOL D40, EXXOL D80, EXXOL D110, EXXOL D130, etc. from Exxon Mobil Corp. and Exxon Chemical Co. Specific examples of the silicone oils include KF96:1~10,000 cst from Shin-Etsu Chemical Co., Ltd., SH200 and SH344 from Toray Silicone Co., Ltd., and TSF451 from GE Toshiba Silicone Co., Ltd.

The carrier liquid preferably has a boiling point of from 100 to 350° C., which has no problem in coloring process and produces high-quality printing. When lower than 100° C., the solvent tends to vaporize before the toner is transferred, resulting in deterioration of transferability thereof, and unwanted odor, insecurity and volatile solvent vapor. When higher than 350° C., the solvent is difficult to vaporize and cannot be removed in coloring process, resulting in deterioration of colorability. When not higher than 350° C., the solvent can be vaporized in the following heating and steaming process.

The dry electrophotographic printing toner preferably has a volume-average particle diameter of from 3 to 20 μm. When less than 3 μm, the toner scatters. When greater than 20 μm, the coloration and resolution deteriorate.

The particle diameter of the dry electrophotographic printing toner is typically measured by Coulter counter. Namely, the toner is dispersed in an electrolyte solution, a voltage is applied from both sides of a cross wall having a small hole, the electrolyte solution having a volume of the toner is excluded from the hole and the electrical resistance between the right and left electrodes instantly increases, causing a voltage pulse. The particle diameter distribution is determined from the number and size of the pulse.

The liquid electrophotographic printing toner preferably has ζ potential absolute value of from 10 to 200 mV to produce high-quality images. When less than 10 mV, the toner agglutinates, the electrophoresis thereof deteriorates, resulting in background fouling and lowering of image density. When greater than 200 mV, an adhesion amount of the toner to a photoreceptor decreases, resulting in possible lowering of image density.

The liquid electrophotographic printing toner preferably has a weight-average particle diameter of from 0.1 to 5 μm to produce high-quality images. When less than 0.1 μm, the resultant images possibly has insufficient image density or possibly are blurred. When greater than 5 μm, the coloration and resolution possibly deteriorate.

After a latent image is developed on a photoreceptor, a transfer roller having a pressure of from 0.1 to 3 $Kg/cm^2$ improves the transferability of a toner even onto a transfer paper or cloth having poor smoothness and forms images having high image density thereon.

An intermediate transferer having higher pressure improves the transferability of a toner onto a transfer paper or cloth having poor smoothness. However, a solvent such as an aliphatic hydrocarbon and a silicone oil is preferably sprayed onto the intermediate transferer because of having less solvent to have better transferability. The sprayed amount is preferably from 0.20 to 0.70 $mg/cm^2$.

It is effective increasing the adhesion amount of a developer, decreasing the squeeze amount of a solvent on the reverse roller after development, and increasing the liquid developer and the solvent permeating clothes to improve the image density.

The transfer voltage is preferably from 1,000 to 7,000 V when directly transfer the toner to clothes. When an intermediate transferer is used, the first transfer voltage is preferably from 100 to 1,000 V and the second transfer voltage is preferably from 300 to 7,000 V.

Conventional printings using a reactive dye, a marketed binder such as Fixer RC, typically perform binding without heating (cold pad batch method).

In the printing of the present invention, a dye adheres to a cloth as a particle, not dissolved, before bound, and the dye is not bound with the cloth by conventional methods. Therefore, energy and water are needed more than the conventional methods to fix the dye with the cloth. In the present invention, for example, a pad steam fixing method is used. A steaming method using a heating steam can also be used besides the pad steam method.

The pad steam method includes the following (i) to (iii):

(i) padding a mixed liquid of alkali aqueous solution including sodium hydrogencarbonate in an amount of from 0.1 to 10% by weight, sodium alginate and CMC onto a produced image;

(ii) fixing the image onto a cloth with a saturated team under an appropriate temperature; and (iii) soaping the cloth.

The particulate dyes can be dissolved with a specific amount of moisture and heat energy by the above-mentioned method. The alkali aqueous solution is not for dissolving the particulate dyes, but for promoting a reaction between a reactive group of the dissolved dye and a reactive group such as an OH group of a cloth.

A conventional printing ink including a dissolved dye adhering to clothes as a colored adhesive before coloring forms a covalent bond from a reaction between a reactive group of the dye and a hydroxyl group of cotton clothes (cellulose). Therefore, conventional methods of coloring and fixing a reactive dye, such as an alkali shock method and a cold batch method can be used as shown in FIG. 5(*a*).

Figure 5:
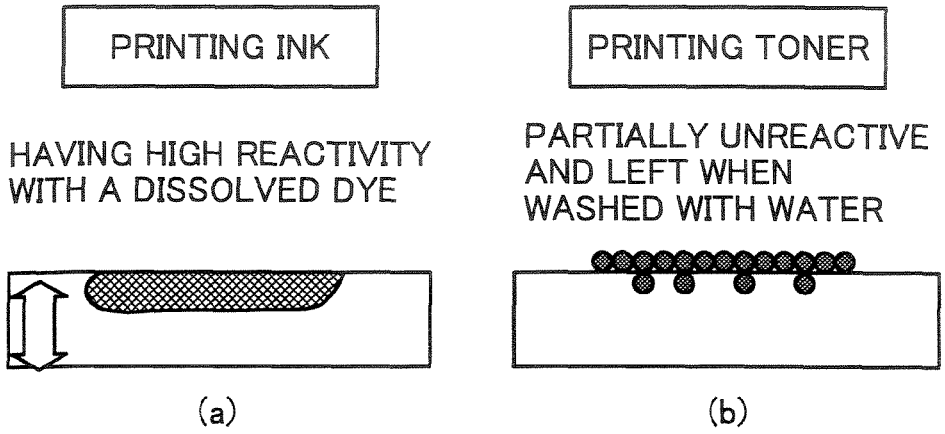
FIG. 5A is a schematic view illustrating an adherence status of a conventional printing ink, wherein a dye is dissolved.
FIG. 5B is a schematic view illustrating an adherence status of a conventional printing toner, wherein a dye is suspended.

As for printing toners, as shown in FIG. 5(*b*), dyes are not dissolved in a solvent and adhere to clothes as particles, and a resin controlling the chargeability adheres around the dye. Therefore, the conventional methods do not sufficiently react a reactive group of the dye with a hydroxyl group of cotton clothes (cellulose), resulting in dyeing insufficiency.

However, the electrophotographic printing toner of the present invention has an equivalent dyeing property to that of a conventional printing ink when colored by the above-mentioned pad steam method.

For cellulose natural fibers such as a cotton and a hemp, a reactive dye dyeing by a covalent bond from a chemical reaction with a functional group in the fiber is preferably used. When the dye having the formula (1), (2) or (3) as a colorant, the resultant toner has good chargeability and dyeing property, and produces images having good image density.

Specific examples of the alkali for use in the pad steam method include hydroxides such as sodium, calcium and barium; sodium carbonate; sodium hydrogencarbonate; ammonium carbonate; and sodium phosphate. Particularly, the sodium hydrogencarbonate (baking soda, $NaHCO_3$) is preferably used.

The alkali aqueous solution needs to have a concentration of from 0.1 to 10% by weight, preferably from 0.5 to 5% by weight, and more preferably from 0.5 to 2% by weight. When less than 0.1% by weight, the reactivity of the dye deteriorates. When greater than 10% by weight, the reactive group of the dye is hydrolyzed and possibly crushed before reacting with cotton clothes (cellulose).

The processing temperature in the pad steam method is preferably from 80 to 140° C., and more preferably from 90 to 110° c. When less than 80° C., the resin and the dye are not sufficiently dissolved, resulting in deterioration of the reactivity. When greater than 140° C., the reactive group of the dye possibly crushes before reacting with clothes.

FIG. 1 is a schematic view illustrating an embodiment of an image forming apparatus using a transfer charger for use in the electrophotographic printing method of the present invention A charger charges a photoreceptor and an irradiator irradiates the photoreceptor to discharge non-image area thereof. A selenium photoreceptor, an organic photoreceptor and an amorphous silicon photo receptor can be used. The photoreceptor preferably has a surface potential of from 400 to 1,600 V. A latent image on which a charge remains on the photoreceptor is developed with a liquid developer fed from a developing roller to form a toner image. A reverse roller removes the redundant liquid developer and a transfer charger applies a charge to the toner image, which is reverse thereto to transfer the toner image to a cloth. The liquid developer includes the liquid electrophotographic printing toner of the present invention.

The developing roller rotates in the forward direction of the photoreceptor, the reverse roller rotates in the reverse direction. It is effective that the developing roller has a linear speed of from 1.2 to 6 times as much as that of the photoreceptor, and that the reverse roller of from 1.2 to 4 times as much as that thereof to produce high-quality images.

A gap between the developing roller and the photoreceptor is preferably from 50 to 250 μm, and that between the reverse roller and the photoreceptor is preferably from 30 to 150 μm. The transfer voltage is preferably from 500 to 4,000 V.

After the toner remaining on the photoreceptor, which is not transferred onto a cloth, is removed with a cleaning blade and cleaning roller, the photoreceptor is discharged.

A charge on an image area may be discharged and a non-image area may remain charged.

Figure 2:
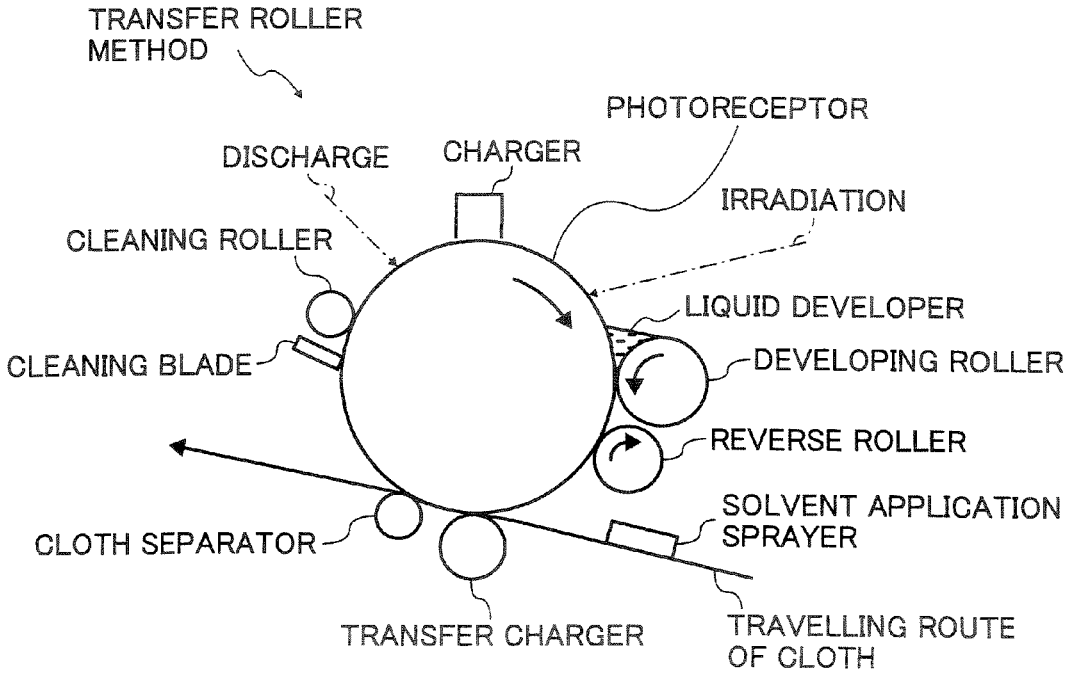
FIG. 2 is a schematic view illustrating an embodiment of an image forming apparatus using a transfer roller for use in the electrophotographic printing method of the present invention.

FIG. 2 is a schematic view illustrating an embodiment of an image forming apparatus using a transfer roller for use in the electrophotographic printing method of the present invention. The transfer roller can apply a pressure when transferring, and has good transferability even on a cloth having a rough surface. The transfer pressure is preferably from 0.1 to 3 $Kg/cm^2$.

Figure 3:
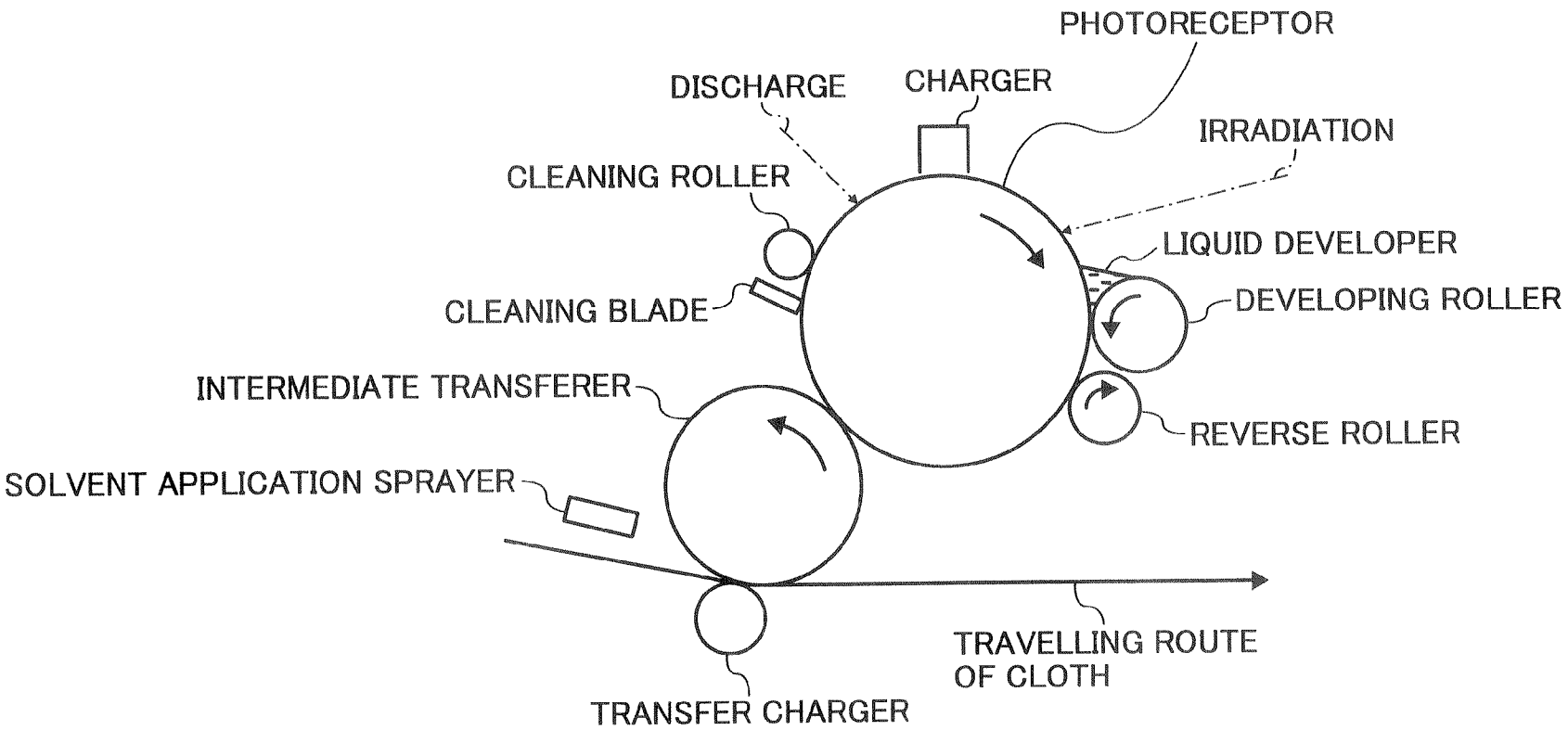
FIG. 3 is a schematic view illustrating the embodiment of an image forming apparatus using a transfer roller in FIG. 2 additionally including an intermediate transferer.

FIG. 3 is a schematic view illustrating the embodiment of an image forming apparatus in FIG. 2 additionally including an intermediate transferer. The transfer roller can apply a higher pressure than that of FIG. 2, and has better transferability even on a cloth having a rough surface. The first transfer pressure is preferably from 0.1 to 3 $Kg/cm^2$, and the second transfer pressure is preferably from 0.1 to 5 $Kg/cm^2$. However, a solvent in the toner when first-transferred onto the intermediate transferer decreases, and is possibly insufficient for the second transfer of the toner onto a cloth. Therefore, a solvent is preferably sprayed onto the intermediate transferer before the second transfer.

Figure 4:
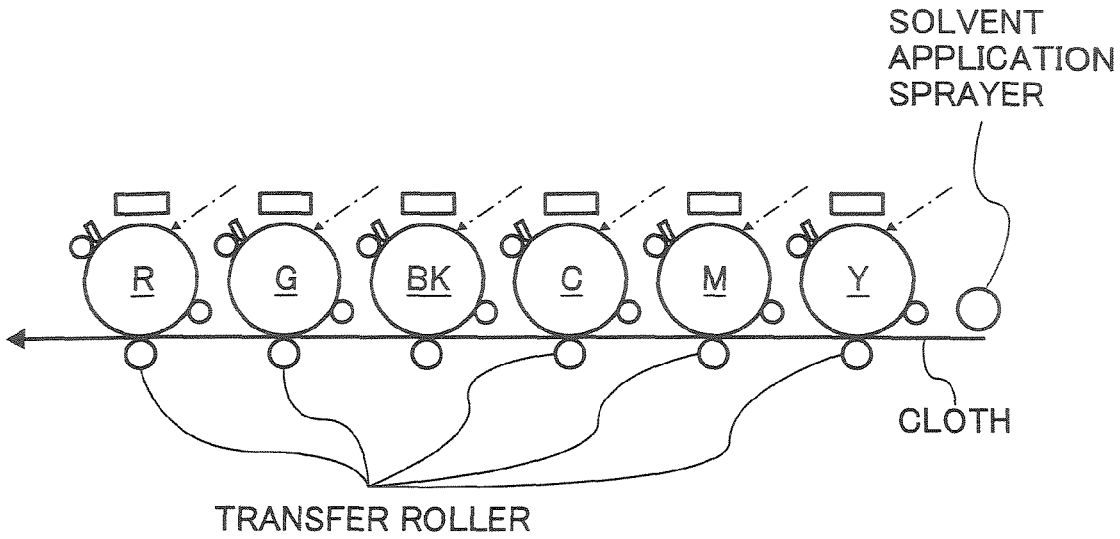
FIG. 4 is a schematic view illustrating a full-color printing apparatus including tandem photoreceptors and transfer rollers for yellow, magenta, cyan, black, green and red from the right, and conveying a cloth attached to a transfer belt thereof.

FIG. 4 is a schematic view illustrating a full-color printing apparatus including tandem photoreceptors and conveying a cloth attached to a transfer belt thereof, which is capable of performing high-quality full-color printing at high speed. The transfer rollers in FIG. 4 are for yellow (Y), magenta (M), cyan (C), black (B), green (G) and red (R) from the right. The tandem electrophotographic image forming apparatus includes plural (typically four) photoreceptors, which produces full-color images at high speed.

Having generally described this invention, further understanding can be obtained by reference to certain specific examples which are provided herein for the purpose of illustration only and are not intended to be limiting. A cotton cloth having 200 broad (warp 120/inch+woof 80/inch) having a thickness of No. 40 was attached to a paper to be printed. In the descriptions in the following examples, the numbers represent weight ratios in parts, unless otherwise specified.

EXAMPLES

Example 1-1

The following materials were dispersed in a pin mill for 10 hrs.

| | |
|---|---|
| Dye 1A in Table 1 (purity of 50% by weight) | 83 |
| Solution of Laurylmethacrylate/methylmethacrylate/methacrylic acid (80/10/10) copolymer including ISOPER-H in an amount of 20% by weight | 100 |
| Rosin-modified phenol resin (DU PONT-MITSUI POLYCHEMICALS CO., LTD.) | 60 |
| Water-soluble resin POVAL (PVA) (Kuraray Co., Ltd.) | 65 |
| ISOPER-H | 180 |
| Charge controlling agent (Zirconium naphthenate) | 3 |

Further, 300 parts of ISOPER-H were added to the dispersion, and dispersed for 1 hr to prepare a condensed liquid electrophotographic printing toner. ISPER-H has a volume resistivity of $2.5\times10^{14}$ Ω·cm and a boiling point of 184° C.

100 g of the condensed liquid electrophotographic printing toner was mixed and dispersed in 1 litter of ISOPER-H, and electrophotographic printing was performed by the apparatus in FIG. 1 using the dispersion.

Example 1-2

The following materials were kneaded with BUSS CO-KNEADER, cooled, crushed with a pulverizer, pulverized with a jet mill and classified to prepare a dry electrophotographic printing toner.

The dry electrophotographic printing toner was used in Ricoh dry printer Imagio to perform printing.

| | |
|---|---|
| Dye 1B in Table 1 (purity of 90% by weight) | 22 |
| Styrene-acrylic resin (St/Acrylic acid = 60/40 from Mitsubishi Rayon Co., Ltd.) | 40 |
| Water-soluble resin CABSEN (Water-soluble polyester from Nagase ChemteX Corp.) | 75 |
| Charge controlling agent (Metal complex of salicylic acid derivatives) | 2 |

Example 1-3

The following materials were dispersed in a ball mill for 24 hrs. Further, 250 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of ISOPER-H, and electrophotographic printing was performed by the apparatus in FIG. 2 using the dispersion.

| | |
|---|---|
| Dye 1E in Table 1 (purity of 80% by weight) | 92 |
| Epoxy-modified resin Epicote 802 (from Japan Epoxy Resin) | 20 |
| Water-soluble resin HARIDIP (Water-soluble alkyd resin from Harima Chemicals, Inc.) | 75 |
| Solution of Stearylmethacrylate/methylmethacrylate/methacrylic acid (80/10/10) copolymer including ISOPER-H in an amount of 20% by weight | 100 |
| ISOPER-H | 250 |
| Charge controlling agent (Zirconium octanoate) | 5 |

Example 1-4

The procedure for preparation of the condensed liquid electrophotographic printing toner in Example 1-1 was repeated to prepare a condensed liquid electrophotographic printing toner except for changing the purity of the dye 1A to 90% by weight.

100 g of the condensed liquid electrophotographic printing toner was mixed and dispersed in 1 litter of ISOPER-H, and electrophotographic printing was performed by the apparatus in FIG. 2 using the dispersion.

Example 1-5

The procedure for preparation of the condensed liquid electrophotographic printing toner in Example 1-3 was repeated to prepare a condensed liquid electrophotographic printing toner except for replacing the dispersion medium from ISOPER-H to a silicone oil (KF-96 2cst).

100 g of the condensed liquid electrophotographic printing toner was mixed and dispersed in 1 litter of silicone oil (KF-96 2cst), and electrophotographic printing was performed by the apparatus in FIG. 2 using the dispersion. Silicone oil KF-96 has a volume resistivity of $3.3\times10^{14}$ Ω·cm and a boiling point of 230° C.

Example 1-6

The following materials were dispersed in a batch sand mill for 12 hrs.

| | |
|---|---|
| Dye 1F in Table 1 (purity of 90% by weight) | 68 |
| Rosin-modified phenol resin (DU PONT-MITSUI POLYCHEMICALS CO., LTD.) | 5 |
| Water-soluble resin CABSEN (Water-soluble polyester from Nagase ChemteX Corp.) | 95 |
| Solution of 2-ethylhexymethacrylate/methylmethacrylate/methacrylic acid (80/10/10) copolymer including ISOPER-H in an amount of 20% by weight | 120 |
| ISOPER-H | 200 |
| Charge controlling agent (Zirconium naphthenate) | 2 |

Further, 350 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of ISOPER-M, and electrophotographic printing was performed by the apparatus in FIG. 2 using the dispersion. ISPER-M has a volume resistivity of $3.1\times10^{14}$ Ω·cm and a boiling point of 223° C.

Example 1-7

The following materials were dispersed in a batch sand mill for 12 hrs.

| | |
|---|---|
| Dye 1G in Table 1 (purity of 80% by weight) | 73 |
| Rosin-modified phenol resin (DU PONT-MITSUI POLYCHEMICALS CO., LTD.) | 95 |
| Water-soluble resin CABSEN (Water-soluble polyester from Nagase ChemteX Corp.) | 5 |
| Solution of 2-ethylhexymethacrylate/methylmethacrylate/methacrylic acid (80/10/10) copolymer including ISOPER-H in an amount of 20% by weight | 120 |
| ISOPER-H | 200 |
| Charge controlling agent (Zirconium naphthenate) | 2 |

Further, 350 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of EXOL D30, and electrophotographic printing was performed by the apparatus in FIG. 2 using the dispersion. EXOL D30 has a volume resistivity of $1.4\times10^{14}$ Ω·cm and a boiling point of 150° C.

Example 1-8

The following materials were dispersed in a ball mill for 36 hrs.

| | |
|---|---|
| Dye 1D in Table 1 (purity of 70% by weight) | 80 |
| Solution of Laurylmethacrylate/methylmethacrylate/methacrylic acid (80/10/10) copolymer including ISOPER-H in an amount of 20% by weight | 80 |
| Rosin-modified phenol resin (DU PONT-MITSUI POLYCHEMICALS CO., LTD.) | 50 |
| Water-soluble resin POVAL (PVA) (Kuraray Co., Ltd.) | 55 |
| ISOPER-H | 170 |
| Charge controlling agent (Zirconium naphthenate) | 2 |

Further, 300 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of ISOPER-H, and electrophotographic printing was performed by the apparatus in FIG. 2 using the dispersion.

Example 1-9

The procedures for preparation of the condensed liquid electrophotographic printing toner and electrophotographic printing in Example 1-3 were repeated except for using the apparatus in FIG. 3 including an intermediate transferer.

Example 1-10

The procedures for preparation of the condensed liquid electrophotographic printing toner and electrophotographic printing in Example 1-9 were repeated except for spraying 0.3 mg/cm$^2$ of ISOPER-H onto the intermediate transferer before the second transfer.

Comparative Example 1-1

The procedures for preparation of the condensed liquid electrophotographic printing toner and electrophotographic printing in Example 1-1 were repeated except for replacing the dye 1A with Reactive Yellow 25 (chloroquinosaline derivative) having a purity of 50% by weight.

Comparative Example 1-2

The procedures for preparation of the condensed liquid electrophotographic printing toner and electrophotographic printing in Example 1-3 were repeated except for replacing the dye 1A with Reactive Black 27 (chloroquinosaline derivative) having a purity of 50% by weight.

An aqueous solution of sodium hydrogencarbonate having a concentration of 2% by weight was applied to the printed clothes prepared in Examples 1-1 to 1-10 and Comparative Examples 1-1 to 1-2, and the clothes were steamed at 100° C. for 15 min, left for 1 hr and washed with water, and treated at 80° C. for 5 min with an anion surfactant of 2 g/L to prepare printed samples to evaluate. The results are shown in Table 4.

TABLE 4

| | ID | BF | TX | AD (μm) | ζ PL (mV) | IR (rank) | TR (%) | CCR (%) | BIN (%) |
|---|---|---|---|---|---|---|---|---|---|
| Ex. 1-1 | 0.81 | 5 | 5 | 0.77 | 20.9 | 5 | 63 | 85 | 123 |
| Ex. 1-2 | 0.99 | 5 | 4 | 7.16 | — | 4 | 59 | 91 | 102 |
| Ex. 1-3 | 1.15 | 5 | 5 | 1.16 | 91.5 | 5 | 72 | 97 | 136 |
| Ex. 1-4 | 1.20 | 5 | 5 | 0.91 | 125.6 | 5 | 76 | 97 | 140 |
| Ex. 1-5 | 0.86 | 5 | 5 | 3.16 | 29.3 | 4 | 57 | 85 | 118 |
| Ex. 1-6 | 0.79 | 5 | 5 | 0.61 | 24.9 | 5 | 60 | 80 | 130 |
| Ex. 1-7 | 1.19 | 5 | 5 | 0.71 | 68.3 | 5 | 71 | 90 | 126 |
| Ex. 1-8 | 1.12 | 5 | 5 | 4.59 | 189.6 | 5 | 67 | 89 | 134 |
| Ex. 1-9 | 1.20 | 5 | 5 | 1.16 | 91.5 | 5 | 83 | 97 | 134 |
| Ex. 1-10 | 1.26 | 5 | 5 | 1.16 | 91.5 | 5 | 86 | 97 | 140 |
| Com. Ex. 1-1 | 0.31 | 2 | 5 | 0.60 | 3.1 | 2 | 22 | 44 | 30 |
| Com. Ex. 1-2 | 0.27 | 2 | 5 | 0.54 | 5.0 | 2 | 17 | 45 | 22 |

*ID: Image density was measured by X-Rite.

*BF: Background fouling was evaluated based on a background fouling level sample cloth, having 5 levels (5: best, 1: worst)

TX: Texture was evaluated based on a texture level sample cloth, having 5 levels (5: soft as the original cloth, 4: soft, 3: middle, 2: slightly hard and 1: hard).

AD: Weight-average particle diameter was measured by SA-CP3.

The toner was diluted with ISOPER until having a transmittance of 15% when measured with an integral ball turbidimeter, and filled in a cell for SA-CP3 under the conditions of ACCEL480, MODE: CENT, 3 to 16 channels.

ζ PL: ζ potential was measured with ELS-8000 from OTSUKA ELECTRONICS CO., LTD.

Cell: low-permittivity cell, Electric field: 500 V/cm, and 6-time measurement average mode.

IR: image resolution was evaluated based on a level sample having 5 levels (5: best, 1: worst).

TR: transferability was measured by a tape peeling method.

Transferability = (Density before transfer − Residual density after transfer)/Density before transfer × 100%

CCR: charge controlling rate was measured by an electrodeposition method.

A gap between the electrodes: 1 cm, electrode area: 2 cm × 2 cm, and electrode position time: 100 sec.

BIN: fixing rate was determined by measuring density with X-Rite before and after soaping.

Fixing rate = (density before soaping/density after soaping) × 100%

As is apparent from Table 4, the electrophotographic printing toner of the present invention produced printed clothes having high image density and resolution. Example 1-4 having a higher purity of dye has higher image density. Example 1-5 using a solvent besides the aliphatic hydrocarbon has a dispersibility slightly worse than Example 1-4. Example 1-6 including much water-soluble resin produces images having slightly lower image density. Example 1-7 including less water-soluble resin produces printed clothes having slightly lower texture. Example 1-10, wherein ISOPER-H was sprayed on images on the intermediate transferer before the second transfer such that the images have better transferability than those in Example 1-9, improves image density of the resultant images.

The printing toners prepared in Comparative Examples, having poor charge controllability did not work as a toner.

Example 2-1

The following materials were dispersed in a pin mill for 10 hrs.

| | |
|---|---|
| Dye 2A in Table 2 (purity of 50% by weight) | 90 |
| Solution of Laurylmethacrylate/methylmethacrylate/methacrylic acid (80/10/10) copolymer including ISOPER-H in an amount of 20% by weight | 100 |
| Rosin-modified phenol resin (DU PONT-MITSUI POLYCHEMICALS CO., LTD.) | 60 |
| Water-soluble resin POVAL (PVA) (Kuraray Co., Ltd.) | 65 |
| ISOPER-H (Carrier liquid) | 180 |
| Charge controlling agent (Zirconium naphthenate) | 3 |

Further, 300 parts of ISOPER-H were added to the dispersion, and dispersed for 1 hr to prepare a condensed liquid electrophotographic printing toner. ISPER-H has a volume resistivity of $2.5\times10^{14}$ Ω·cm and a boiling point of 184° C.

100 g of the condensed liquid electrophotographic printing toner was mixed and dispersed in 1 litter of ISOPER-H, and electrophotographic printing was performed by the apparatus in FIG. 1 using the dispersion.

Example 2-2

The following materials were kneaded with BUSS CO-KNEADER, cooled, crushed with a pulverizer, pulverized with a jet mill and classified to prepare a dry electrophotographic printing toner.

The dry electrophotographic printing toner was used in Ricoh dry printer Imagio to perform printing.

| | |
|---|---|
| Dye 2B in Table 2 (purity of 90% by weight) | 25 |
| Styrene-acrylic resin (St/Acrylic acid = 60/40 from Mitsubishi Rayon Co., Ltd.) | 40 |
| Water-soluble resin CABSEN (Water-soluble polyester from Nagase ChemteX Corp.) | 75 |
| Charge controlling agent (Metal complex of salicylic acid derivatives) | 2 |

Example 2-3

The following materials were dispersed in a ball mill for 24 hrs. Further, 250 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of ISOPER-H, and electrophotographic printing was performed by the apparatus in FIG. 2 using the dispersion.

| | |
|---|---|
| Dye 2E in Table 2 (purity of 80% by weight) | 80 |
| Epoxy-modified resin Epicote 802 (from Japan Epoxy Resin) | 20 |

-continued

| | |
|---|---|
| Water-soluble resin HARIDIP (Water-soluble alkyd resin from Harima Chemicals, Inc.) | 75 |
| Solution of Stearylmethacrylate/methylmethacrylate/methacrylic acid (80/10/10) copolymer including ISOPER-H in an amount of 20% by weight | 100 |
| ISOPER-H (carrier liquid) | 250 |
| Charge controlling agent (Zirconium octanoate) | 5 |

Example 2-4

The procedure for preparation of the condensed liquid electrophotographic printing toner in Example 2-1 was repeated to prepare a condensed liquid electrophotographic printing toner except for changing the purity of the dye 2A to 90% by weight.

100 g of the condensed liquid electrophotographic printing toner was mixed and dispersed in 1 litter of ISOPER-H, and electrophotographic printing was performed by the apparatus in FIG. 2 using the dispersion.

Example 2-5

The procedure for preparation of the condensed liquid electrophotographic printing toner in Example 2-3 was repeated to prepare a condensed liquid electrophotographic printing toner except for replacing the dispersion medium from ISOPER-H to a silicone oil (KF-96 2cst).

100 g of the condensed liquid electrophotographic printing toner was mixed and dispersed in 1 litter of silicone oil (KF-96 2cst), and electrophotographic printing was performed by the apparatus in FIG. 2 using the dispersion. Silicone oil KF-96 has a volume resistivity of $3.3\times10^{14}$ Ω·cm and a boiling point of 230° C.

Example 2-6

The following materials were dispersed in a batch sand mill for 12 hrs.

| | |
|---|---|
| Dye 2F in Table 2 (purity of 90% by weight) | 80 |
| Rosin-modified phenol resin (DU PONT-MITSUI POLYCHEMICALS CO., LTD.) | 5 |
| Water-soluble resin CABSEN (Water-soluble polyester from Nagase ChemteX Corp.) | 95 |
| Solution of 2-ethylhexymethacrylate/methylmethacrylate/methacrylic acid (80/10/10) copolymer including ISOPER-H in an amount of 20% by weight | 120 |
| ISOPER-H | 200 |
| Charge controlling agent (Zirconium naphthenate) | 2 |

Further, 350 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of ISOPER-M, and electrophotographic printing was performed by the apparatus in FIG. 2 using the dispersion. ISPER-M has a volume resistivity of $3.1\times10^{14}$ Ω·cm and a boiling point of 223° C.

Example 2-7

The following materials were dispersed in a batch sand mill for 12 hrs.

| | |
|---|---|
| Dye 2G in Table 2 (purity of 80% by weight) | 70 |
| Rosin-modified phenol resin (DU PONT-MITSUI POLYCHEMICALS CO., LTD.) | 95 |
| Water-soluble resin CABSEN (Water-soluble polyester from Nagase ChemteX Corp.) | 5 |
| Solution of 2-ethylhexymethacrylate/methylmethacrylate/methacrylic acid (80/10/10) copolymer including ISOPER-H in an amount of 20% by weight | 120 |
| ISOPER-H | 200 |
| Charge controlling agent (Zirconium naphthenate) | 2 |

Further, 350 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of EXOL D30, and electrophotographic printing was performed by the apparatus in FIG. 2 using the dispersion. EXOL D30 has a volume resistivity of $1.4\times10^{14}$ Ω·cm and a boiling point of 150° C.

Example 2-8

The procedures for preparation of the condensed liquid electrophotographic printing toner and electrophotographic printing in Example 2-3 were repeated except for using the apparatus in FIG. 1.

Example 2-9

The procedures for preparation of the condensed liquid electrophotographic printing toner and electrophotographic printing in Example 2-3 were repeated except for using the apparatus in FIG. 3 including an intermediate transferer.

Example 2-10

The procedures for preparation of the condensed liquid electrophotographic printing toner and electrophotographic printing in Example 2-9 were repeated except for spraying 0.3 mg/cm$^2$ of ISOPER-H onto the intermediate transferer before the second transfer.

Comparative Example 2-1

The procedures for preparation of the condensed liquid electrophotographic printing toner and electrophotographic printing in Example 2-1 were repeated except for replacing the dye 2A with Reactive Black 1 having a purity of 50% by weight and the following formula:

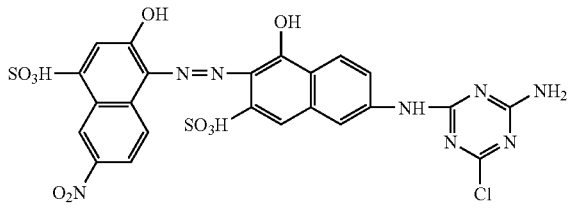

Comparative Example 2-2

The procedures for preparation of the condensed liquid electrophotographic printing toner and electrophotographic printing in Example 2-3 were repeated except for replacing the dye 2E with Reactive Black 4 having a purity of 50% by weight.

Sodium silicate (45 to 48° BOME) was applied to the printed clothes prepared in Examples 2-1 to 2-10 and Comparative Examples 2-1 to 2-2, left for 20 hrs and washed with water, and treated at 80° C. for 5 min with an anion surfactant of 2 g/L to prepare printed samples to evaluate. The results are shown in Table

TABLE 5

| | ID | BF | TX | AD (μm) | ζ PL (mV) | IR (rank) | TR (%) | CCR (%) | BIN (%) |
|---|---|---|---|---|---|---|---|---|---|
| Ex. 2-1 | 1.01 | 5 | 5 | 0.88 | 19.3 | 5 | 65 | 88 | 132 |
| Ex. 2-2 | 1.17 | 5 | 4 | 7.62 | — | 4 | 60 | 90 | 106 |
| Ex. 2-3 | 1.30 | 5 | 5 | 1.21 | 96.5 | 5 | 75 | 98 | 140 |
| Ex. 2-4 | 1.39 | 5 | 5 | 0.99 | 135.6 | 5 | 79 | 98 | 143 |
| Ex. 2-5 | 1.06 | 5 | 5 | 3.46 | 23.3 | 4 | 59 | 87 | 121 |
| Ex. 2-6 | 0.91 | 5 | 5 | 0.81 | 26.9 | 5 | 62 | 81 | 135 |
| Ex. 2-7 | 1.34 | 5 | 3 | 0.78 | 78.3 | 5 | 73 | 92 | 129 |
| Ex. 2-8 | 1.17 | 5 | 5 | 1.21 | 96.5 | 5 | 59 | 98 | 138 |
| Ex. 2-9 | 1.40 | 5 | 5 | 1.21 | 96.5 | 5 | 85 | 98 | 137 |
| Ex. 2-10 | 1.45 | 5 | 5 | 1.21 | 96.5 | 5 | 89 | 98 | 141 |
| Com. Ex. 2-1 | 0.36 | 2 | 5 | 0.65 | 3.1 | 2 | 24 | 46 | 32 |
| Com. Ex. 2-2 | 0.29 | 2 | 5 | 0.58 | 5.3 | 2 | 19 | 47 | 25 |

The valuation items and standards are same as those in Table 4.

As is apparent from Table 5, the electrophotographic printing toner of the present invention produced printed clothes having high image density and resolution. Example 2-4 having a higher purity of dye has higher image density. Example 2-5 using a solvent besides the aliphatic hydrocarbon has a dispersibility slightly worse than Example 2-4. Example 2-6 including much water-soluble resin produces images having slightly lower image density. Example 2-7 including less water-soluble resin produces printed clothes having slightly lower texture. Example 2-10, wherein ISOPER-H was sprayed on images on the intermediate transferer before the second transfer such that the images have better transferability, improves image density of the resultant images.

The printing toners prepared in Comparative Examples, having poor charge controllability did not work as a toner.

Example 3-1

The following materials were dispersed in a pin mill for 10 hrs.

| | |
|---|---|
| Dye 3A in Table 3 (purity of 50% by weight) | 93 |
| Solution of Laurylmethacrylate/methylmethacrylate/methacrylic acid (80/10/10) copolymer including ISOPER-H in an amount of 20% by weight | 100 |
| Rosin-modified phenol resin (DU PONT-MITSUI POLYCHEMICALS CO., LTD.) | 60 |
| Water-soluble resin POVAL (PVA) (Kuraray Co., Ltd.) | 65 |
| ISOPER-H (carrier liquid) | 185 |
| Charge controlling agent (Zirconium naphthenate) | 3 |

Further, 300 parts of ISOPER-H were added to the dispersion, and dispersed for 1 hr to prepare a condensed liquid electrophotographic printing toner. ISPER-H has a volume resistivity of $2.5\times10^{14}$ Ω·cm and a boiling point of 184° C.

100 g of the condensed liquid electrophotographic printing toner was mixed and dispersed in 1 litter of ISOPER-H, and electrophotographic printing was performed by the apparatus in FIG. 1 using the dispersion.

Example 3-2

The following materials were kneaded with BUSS CO-KNEADER, cooled, crushed with a pulverizer, pulverized with a jet mill and classified to prepare a dry electrophotographic printing toner.

The dry electrophotographic printing toner was used in Ricoh dry printer Imagio to perform printing.

| | |
|---|---|
| Dye 3B in Table 3 (purity of 90% by weight) | 29 |
| Styrene-acrylic resin (St/Acrylic acid = 60/40 from Mitsubishi Rayon Co., Ltd.) | 40 |
| Water-soluble resin CABSEN (Water-soluble polyester from Nagase ChemteX Corp.) | 75 |
| Charge controlling agent (Metal complex of salicylic acid derivatives) | 2 |

Example 3-3

The following materials were dispersed in a ball mill for 24 hrs. Further, 250 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of ISOPER-H, and electrophotographic printing was performed by the apparatus in FIG. 2 using the dispersion.

| | |
|---|---|
| Dye 3E in Table 3 (purity of 80% by weight) | 83 |
| Epoxy-modified resin Epicote 802 (from Japan Epoxy Resin) | 20 |
| Water-soluble resin HARIDIP (Water-soluble alkyd resin from Harima Chemicals, Inc.) | 75 |
| Solution of Stearylmethacrylate/methylmethacrylate/methacrylic acid (80/10/10) copolymer including ISOPER-H in an amount of 20% by weight | 100 |
| ISOPER-H (carrier liquid) | 250 |
| Charge controlling agent (Zirconium octanoate) | 5 |

Example 3-4

The procedure for preparation of the condensed liquid electrophotographic printing toner in Example 3-1 was repeated to prepare a condensed liquid electrophotographic printing toner except for changing the purity of the dye 3A to 90% by weight.

100 g of the condensed liquid electrophotographic printing toner was mixed and dispersed in 1 litter of ISOPER-H, and electrophotographic printing was performed by the apparatus in FIG. 2 using the dispersion.

Example 3-5

The procedure for preparation of the condensed liquid electrophotographic printing toner in Example 3-3 was repeated to prepare a condensed liquid electrophotographic printing toner except for replacing the dispersion medium from ISOPER-H to a silicone oil (KF-96 2cst).

100 g of the condensed liquid electrophotographic printing toner was mixed and dispersed in 1 litter of silicone oil (KF-96 2cst), and electrophotographic printing was performed by the apparatus in FIG. 2 using the dispersion. Silicone oil KF-96 has a volume resistivity of $3.3\times10^{14}$ Ω·cm and a boiling point of 230° C.

Example 3-6

The following materials were dispersed in a batch sand mill for 12 hrs.

| | |
|---|---|
| Dye 3F in Table 3 (purity of 90% by weight) | 80 |
| Rosin-modified phenol resin (DU PONT-MITSUI POLYCHEMICALS CO., LTD.) | 5 |
| Water-soluble resin CABSEN (Water-soluble polyester from Nagase ChemteX Corp.) | 95 |
| Solution of 2-ethylhexymethacrylate/methylmethacrylate/methacrylic acid (80/10/10) copolymer including ISOPER-H in an amount of 20% by weight | 120 |
| ISOPER-H | 210 |
| Charge controlling agent (Zirconium naphthenate) | 2 |

Further, 350 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of ISOPER-M, and electrophotographic printing was performed by the apparatus in FIG. 2 using the dispersion. ISPER-M has a volume resistivity of $3.1\times10^{14}$ Ω·cm and a boiling point of 223° C.

Example 3-7

The following materials were dispersed in a batch sand mill for 12 hrs.

| | |
|---|---|
| Dye 3G in Table 3 (purity of 80% by weight) | 72 |
| Rosin-modified phenol resin (DU PONT-MITSUI POLYCHEMICALS CO., LTD.) | 95 |
| Water-soluble resin CABSEN (Water-soluble polyester from Nagase ChemteX Corp.) | 5 |
| Solution of 2-ethylhexymethacrylate/methylmethacrylate/methacrylic acid (80/10/10) copolymer including ISOPER-H in an amount of 20% by weight | 120 |
| ISOPER-H | 210 |
| Charge controlling agent (Zirconium naphthenate) | 2 |

Further, 350 parts of ISOPER-H were added to the dispersion, and dispersed for 1 hr to prepare a condensed liquid electrophotographic printing toner.

100 g of the condensed liquid electrophotographic printing toner was mixed and dispersed in 1 litter of EXOL D30, and electrophotographic printing was performed by the apparatus in FIG. 2 using the dispersion. EXOL D30 has a volume resistivity of $1.4\times10^{14}$ Ω·cm and a boiling point of 150° C.

Example 3-8

The procedures for preparation of the condensed liquid electrophotographic printing toner and electrophotographic printing in Example 3-3 were repeated except for using the apparatus in FIG. 1.

Example 3-9

The procedures for preparation of the condensed liquid electrophotographic printing toner and electrophotographic printing in Example 3-3 were repeated except for using the apparatus in FIG. 3 including an intermediate transferer.

Example 3-10

The procedures for preparation of the condensed liquid electrophotographic printing toner and electrophotographic printing in Example 3-9 were repeated except for spraying 0.3 mg/cm$^2$ of ISOPER-H onto the intermediate transferer before the second transfer.

Comparative Example 3-1

The procedures for preparation of the condensed liquid electrophotographic printing toner and electrophotographic printing in Example 3-1 were repeated except for replacing the dye 3A with Reactive Black 1 having a purity of 50% by weight and the following formula:

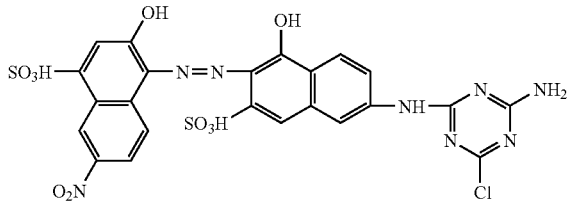

Comparative Example 3-2

The procedures for preparation of the condensed liquid electrophotographic printing toner and electrophotographic printing in Example 3-3 were repeated except for replacing the dye 3E with Reactive Black 4 having a purity of 50% by weight.

Sodium silicate (45 to 480 BOME) was applied to the printed clothes prepared in Examples 3-1 to 3-10 and Comparative Examples 3-1 to 3-2, left for 20 hrs and washed with water, and treated at 80° C. for 5 min with an anion surfactant of 2 g/L to prepare printed samples to evaluate. The results are shown in Table 6.

TABLE 6

| | ID | BF | TX | AD (μm) | ζ PL (mV) | IR (rank) | TR (%) | CCR (%) | BIN (%) |
|---|---|---|---|---|---|---|---|---|---|
| Ex. 3-1 | 1.00 | 5 | 5 | 0.83 | 20.2 | 5 | 68 | 89 | 130 |
| Ex. 3-2 | 1.15 | 5 | 4 | 7.12 | — | 4 | 58 | 92 | 102 |
| Ex. 3-3 | 1.28 | 5 | 5 | 1.10 | 96.0 | 5 | 74 | 97 | 138 |
| Ex. 3-4 | 1.37 | 5 | 5 | 0.97 | 125.6 | 5 | 78 | 97 | 140 |
| Ex. 3-5 | 1.04 | 5 | 5 | 3.26 | 21.3 | 4 | 58 | 85 | 120 |
| Ex. 3-6 | 0.90 | 5 | 5 | 0.80 | 23.9 | 5 | 61 | 82 | 133 |
| Ex. 3-7 | 1.32 | 5 | 3 | 0.72 | 68.3 | 5 | 71 | 91 | 127 |
| Ex. 3-8 | 1.15 | 5 | 5 | 1.10 | 96.0 | 5 | 57 | 97 | 137 |

TABLE 6-continued

| | ID | BF | TX | AD (μm) | ζ PL (mV) | IR (rank) | TR (%) | CCR (%) | BIN (%) |
|---|---|---|---|---|---|---|---|---|---|
| Ex. 3-9 | 1.37 | 5 | 5 | 1.10 | 96.0 | 5 | 83 | 98 | 136 |
| Ex. 3-10 | 1.42 | 5 | 5 | 1.10 | 96.0 | 5 | 88 | 98 | 141 |
| Com. Ex. 3-1 | 0.32 | 2 | 5 | 0.60 | 3.9 | 2 | 23 | 47 | 35 |
| Com. Ex. 3-2 | 0.46 | 2 | 5 | 0.54 | 5.3 | 2 | 26 | 49 | 29 |

The valuation items and standards are same as those in Table 4.

As is apparent from Table 6, the electrophotographic printing toner of the present invention produced printed clothes having high image density and resolution. Example 3-4 having a higher purity of dye has higher image density. Example 3-5 using a solvent besides the aliphatic hydrocarbon has a dispersibility slightly worse than Example 3-4. Example 3-6 including much water-soluble resin produces images having slightly lower image density. Example 3-7 including less water-soluble resin produces printed clothes having slightly lower texture. Example 3-10, wherein ISOPER-H was sprayed on images on the intermediate transferer before the second transfer such that the images have better transferability, improves image density of the resultant images.

The printing toners prepared in Comparative Examples, having poor charge controllability did not work as a toner.

This application claims priority and contains subject matter related to Japanese Patent Application No. 2006-151791, filed on May 31, 2006; and Japanese Patent Application No. 2007-036209, filed Feb. 16, 2007, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letter Patent of the the United States is:

1. An electrophotographic printing toner, comprising:

a colorant; and a resin, wherein the colorant comprises at least one dye having at least one reactive group selected from the group consisting of $NHCOC_nH_{2n}OSO_3H$, $NHSO_2C_nH_{2n}OSO_3H$, $COC_nH_{2n}OSO_3H$, and $SO_2CHCH_2$, wherein n is an integer of from 1 to 4.

2. The electrophotographic printing toner of claim 1, wherein the colorant comprises at least one dye that has the following formula (1):

(1)

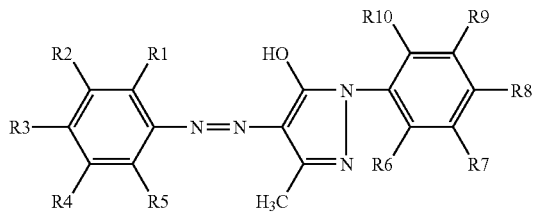

wherein R1 to R10 independently represent H, $C_nH_{2n+1}$, $OC_nH_{2n+1}$, $OCOC_nH_{2n+1}$, COOH, Cl, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, and n is an integer of from 1 to 4.

3. The electrophotographic printing toner of claim 1, wherein the colorant comprises at least one dye that has the following formula (2):

(2)

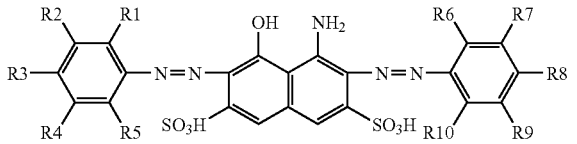

wherein R1 to R10 independently represent H, $OC_nH_{2n+1}$, $NO_2$, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, and n is an integer of from 1 to 4.

4. The electrophotographic printing toner of claim 1, wherein the colorant comprises at least one dye that has the following formula (3):

(3)

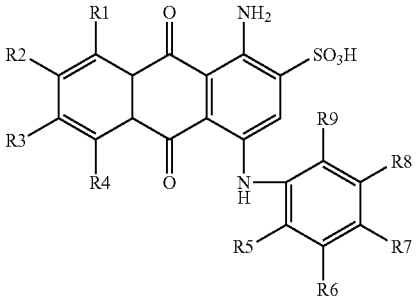

wherein R1 to R9 independently represent H, $OC_nH_{2n+1}$, $NO_2$, $SO_3H$, $SO_2C_nH_{2n}OSO_3H$, $NHCOC_nH_{2n}OSO_3H$, $NHSO_2C_nH_{2n}OSO_3H$, $COC_nH_{2n}OSO_3H$ and $SO_2CHCH_2$, and n is an integer of from 1 to 4.

5. The electrophotographic printing toner of claim 1, wherein the colorant comprises at least one dye in an amount of from 80 to 100% by weight.

6. The electrophotographic printing toner of claim 1, wherein the resin comprises at least one of an alkali-soluble resin and a water-soluble resin.

7. The electrophotographic printing toner of claim 6, wherein the alkali-soluble resin or water-soluble resin has an acid value of from 0 to 2,000 mg/KOH.

8. The electrophotographic printing toner of claim 1, wherein the colorant is dispersed in a carrier liquid having a high resistivity and a low permittivity, and wherein the toner is a liquid.

9. The electrophotographic printing toner of claim 8, wherein the carrier liquid has a volume resistivity not less than $10^9$ Ω·cm.

10. The electrophotographic printing toner of claim 8, wherein the carrier liquid is a saturated aliphatic hydrocarbon having a boiling point of from 100 to 350° C. at normal temperature and pressure.

11. The electrophotographic printing toner of claim 1, wherein the toner has an absolute value ζof potential of from 10 to 200 mV.

12. The electrophotographic printing toner of claim 1, wherein the toner has a weight-average particle diameter of from 0.1 to 5 μm.

13. An electrophotographic printing method, comprising:

charging a photoreceptor;

irradiating the photoreceptor to form an electrostatic latent image thereon;

developing the electrostatic latent image with the toner according to claim 1 to form a toner image on the photoreceptor; and transferring the toner image onto a transfer material with an electrostatic force and a pressure of a transfer roller.

14. The method of claim 13, wherein said transfer material is a textile.

15. The electrophotographic printing method of claim 13, wherein transferring the toner image onto the transfer material through an intermediate transferer.

16. The electrophotographic printing method of claim 15, further comprising:

spraying a solvent to the intermediate transferer before transferring the toner image therefrom onto the transfer material.

17. The electrophotographic printing method of claim 13, wherein a developing roller developing the electrostatic latent image has a linear speed of from 1.2 to 6 times and a reverse roller removing an excess solvent has a linear speed of from 1.2 to 4 times as fast as a linear speed of the photoreceptor.

18. The electrophotographic printing method of claim 13, further comprising plural tandem photoreceptors, wherein a full-color image is transferred onto a transfer material attached to a belt to be full-color printed.

19. The electrophotographic printing method of claim 13, further comprising:

fixing the toner image on the transfer material by a pad steam method using an alkaline aqueous solution having a concentration of from 0.1 to 10% by weight.

20. A liquid developer for electrophotographic printing, comprising the electrophotographic printing toner according to claim 1.

* * * * *